United States Patent [19]

Herman

[11] 4,128,088

[45] Dec. 5, 1978

[54] APPARATUS AND SYSTEM FOR CONTROLLING THE AIR-FUEL RATIO SUPPLIED TO A COMBUSTION CARBURETOR

[75] Inventor: Ronald E. Herman, Romeo, Mich.

[73] Assignee: Colt Industries Operating Corp., New York, N.Y.

[21] Appl. No.: 684,548

[22] Filed: May 10, 1976

[51] Int. Cl.[2] ..... F02M 11/00

[52] U.S. Cl. ..... 123/119 EC; 261/39 A; 261/69 R

[58] Field of Search ..... 261/69 R, 39 A, 121 B; 123/119 R, 119 EC

[56] References Cited

U.S. PATENT DOCUMENTS

| | | | |
|---|---|---|---|
| 3,730,157 | 5/1973 | Gerhald | 123/119 R |
| 3,857,908 | 12/1974 | Brown | 261/121 B |
| 3,906,910 | 9/1975 | Szlaga | 123/119 EC |
| 3,921,612 | 11/1975 | Aono | 123/119 EC |
| 3,933,951 | 1/1976 | Fischer | 261/121 B |
| 3,978,834 | 9/1976 | Arnaud | 123/119 A |

*Primary Examiner*—Ronald H. Lazarus

*Attorney, Agent, or Firm*—Walter Potoroka, Sr.

[57] ABSTRACT

A carbureting type fuel metering apparatus has an induction passage into which fuel is fed by several fuel metering systems among which are a main fuel metering system and an idle fuel metering system, as generally known in the art; engine exhaust analyzing means sensitive to selected constituents of such exhaust gas creates feedback signal means which through associated transducer means become effective for controllably modulating the metering characteristics of the main fuel metering system and the idle fuel metering system.

24 Claims, 7 Drawing Figures

APPARATUS AND SYSTEM FOR CONTROLLING THE AIR-FUEL RATIO SUPPLIED TO A COMBUSTION CARBURETOR

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of governments as being insufficient. Further, such levels of government have also imposed regulations specifying the maximum permissible amounts of various pollutants including carbon monoxide (CO), hydrocarbons (HC), and oxides of nitrogen ($NO_x$) which may be emitted by the engine exhaust gases into the atmosphere.

Unfortunately, the available technology employable in attempting to attain increases in engine fuel economy is generally contrary to that technology employable in attempting to meet the governmentally imposed standards on exhaust gas emissions.

For example, the prior art, in trying to meet the standards for $NO_x$ emissions, has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofore proposed retarding of the engine ignition timing as a further means for reducing the creation of $NO_x$. Also, lower engine compression ratios have been employed in order to lower the resulting combustion chamber and thereby reduce the creation of $NO_x$.

The prior art has also proposed the use of fuel metering injection means for eliminating the usually employed carbureting apparatus and, under superatmospheric pressure, injecting the fuel into either the engine intake manifold or directly into the combustion chamber means such as the cylinders of a piston type internal combustion engine. Such fuel injection systems, besides being costly, have not proven to be generally successful in that the system is required to provide metered fuel flow over a very wide range. Generally, those injection systems which are very accurate at one end of the required range of metered fuel flows are inaccurate at the opposite end of that same range of metered fuel flows. Also, those injection systems which are made to be accurate in the mid-portion of the required range of metered fuel flows are usually relatively inaccurate at both ends of that same range. The use of feedback means for altering the metering characteristics of a particular fuel injection system have not solved the problem because the problem usually is intertwined within such factors as: effective aperture area of the injection nozzle; comparative movement required by the associated nozzle pintle or valving member; and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits of, for example, 1.0 gram/mile of $NO_x$ (or even less).

The prior art, in view of such anticipated requirements with respect to $NO_x$, has suggested the employment of a "three-way" catalyst, in a single bed, within the stream of exhaust gases as a means of attaining such anticipated exhaust emission limits. Generaly, a "three-way" catalyst is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively but the oxidation of CO will be incomplete; if the fuel metering is too lean, the CO will be effectively oxidized but the reduction of NOX will be incomplete. Obviously, in order to make such a "three-way" catalyst operative, it is necessary to have very accurate control over the fuel metering function of associated fuel metering supply means feeding the engine. Some systems may additionally have a small oxidizing catalyst bed downstream of the three-way catalyst bed to provide further oxidation of CO and HC. Such systems will require that additional oxygen supplied by air pump means be injected downstream of the three-way catalyst bed but upstream of the oxidizing catalyst bed. Such a system can provide very low levels of pollutants in the exhaust gases and also provide a source of air at superatmospheric pressure.

As hereinbefore described, the prior art has suggested the use of fuel injection means with associated feedback means (responsive to selected indicia of engine operating conditions and parameters) intended to continuously alter or modify the metering characteristics of the fuel injection means. However, as also hereinbefore indicated, such fuel injection systems are very costly and have not generally proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means can never provide the degree of accuracy required in the metering of fuel to an associated engine as to assure meeting, for example, the said anticipated exhaust emission standards.

Accordingly, the invention as disclosed, described and claimed is directed generally to the solution of the above and related problems and more specificaly to structure, apparatus and systems enabling a carbureting type fuel metering device to meter fuel with an accuracy at least sufficient to meet the said anticipated standards regarding engine exhaust gas emissions.

SUMMARY OF THE INVENTION

According to the invention, a carburetor having an induction passage therethrough with a venturi therein has a main fuel discharge nozzle situated generaly within the venturi and a main fuel metering system communicarting generally between a fuel reservoir and the main fuel discharge nozzle. An idle fuel metering system communicates generally between a fuel reservoir and said induction passage at a location generally in close proximity to an edge of a variably openable throttle valve situated in said induction passage downstream of the main fuel discharge nozzle. Pressure responsive modulating valving means are provided to controllably alter the rate of metered fuel flow through each of said main and idle fuel metering systems in response to control signals generated as a consequence of selected indicia of engine operation. Suitable means such as pump means is employed in order to thereby provide a source of superatmospheric fluid pressure employable in the actuation of said pressure responsive modulating valving means.

Various general and specific objects and advantages of the invention will become apparent when reference is made to the following detailed description of the invention considered in conjunction with the related drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENTS

Figure 1:
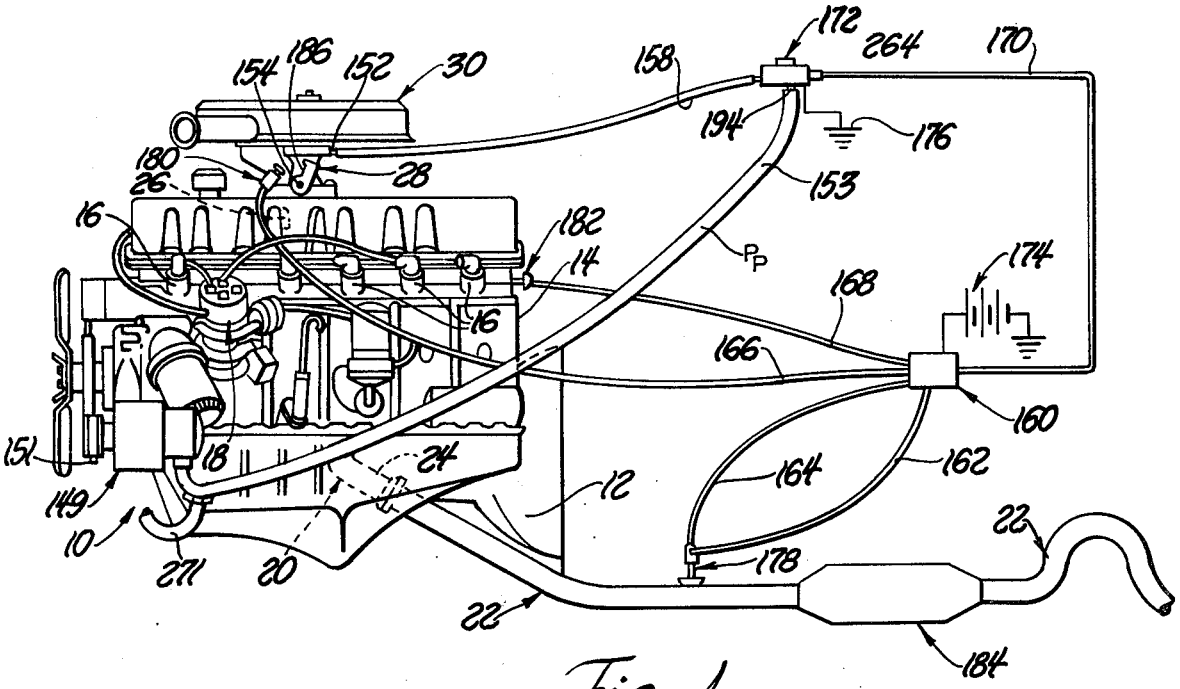
FIG. 1 illustrates, in side elevational view, a vehicular combustion engine employing a carbureting apparatus and system embodying teachings of the invention.

Referring now in greater detail to the drawings, FIG. 1 illustrates a combustion engine 10 used, for example, to propel an associated vehicle as through power transmission means fragmentarily illustrated at 12 and associated ground engaging drive wheels (not shown). The engine 10 may be of the internal combustion type employing, as is generally well known in the art, a plurality of power piston means therein. As generally depicted, the engine assembly 10 is shown as being comprised of an engine block 14 containing, among other things, a plurality of cylinders respectively reciprocatingly receiving said power pistons therein. A plurality of spark or ignition plugs 16, are for each cylinder, are carried by the engine block and respectively electrically connected to an ignition distributor assembly 18 operated in timed relationship to engine operation.

As is generally well known in the art, each cylinder containing a power piston has exhaust aperture or port means and such exhaust port means communicate as with an associated exhaust manifold which is fragmentarily illustrated in hidden line at 20. Exhaust conduit means 22 is shown operatively connected to the discharge end 24 of exhaust manifold 20 and leading as to the rear of the associated vehicle for the discharging of exhaust gases to the atmosphere.

Further, as is also generally well known in the art, each cylinder which contains a power piston also has inlet aperture or port means and such inlet aperture means communicate as with an associated inlet manifold which is fragmentarily illustrated in hidden line at 26.

As generally depicted, a carbureting type fuel metering apparatus 28 is situated atop a cooperating portion of the inlet or intake manifold means 26. A suitable inlet air cleaner assembly 30 may be situated atop the carburetor assembly 28 as to filter the air prior to its entrance into the inlet of the carburetor 28.

Figure 2:
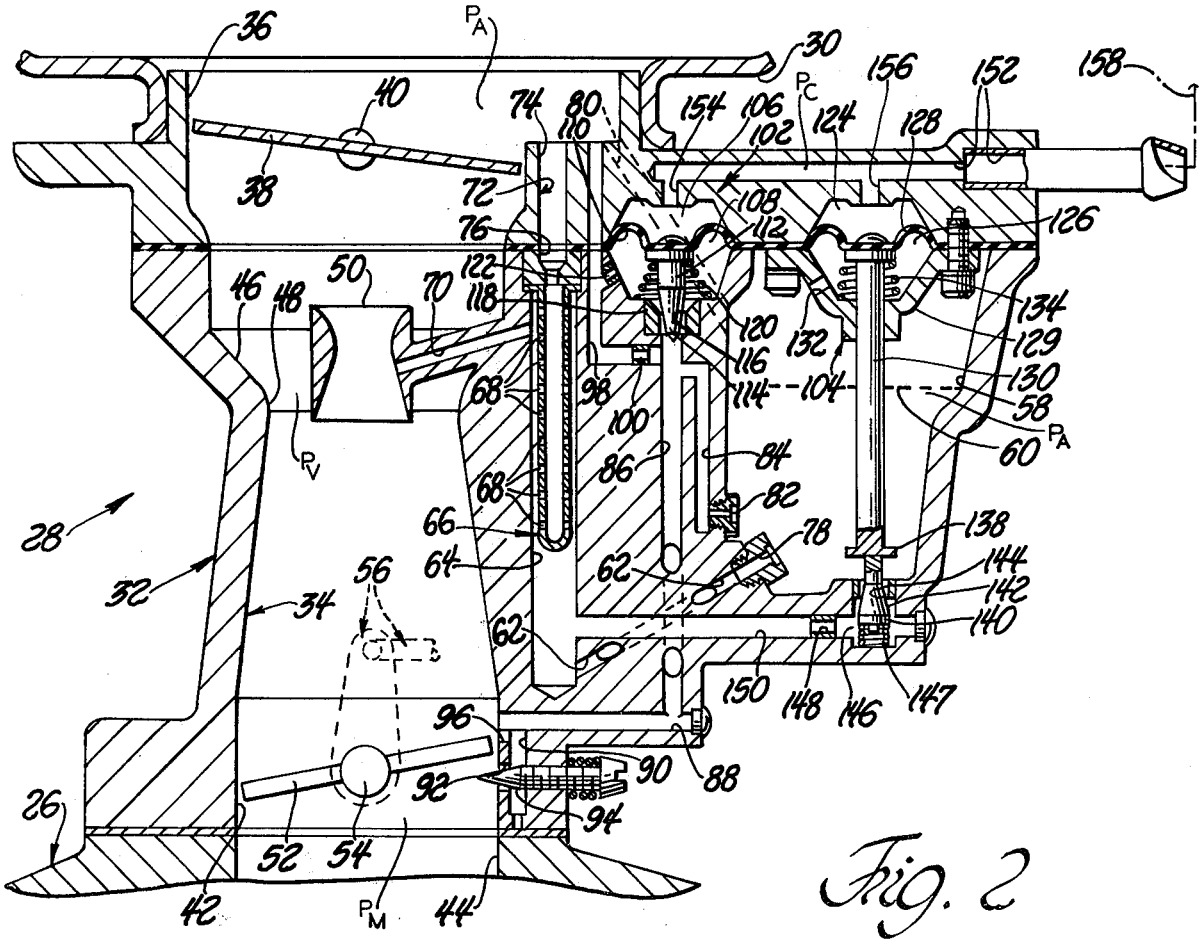
FIG. 2 is an enlarged view of a carburetor assembly, in cross-section, constructed in accordance with the invention.

As generally shown in FIG. 2, the carburetor 28, employing teachings of the invention, comprises a main carburetor body 32 having induction passage means 34 formed therethrough with an upper inlet end 36, in which generally is situated a variably openable choke valve 38 carried as by a pivotal shock shaft 40, and a discharge end 42 communicating as with the inlet 44 of intake manifold 26. A venturi section 46, having a venturi throat 48, is provided within the induction passage means 34 generally between the inlet 36 and outlet or discharge end 42. A main metered fuel discharge nozzle 50, situated generaly within the throat 48 of venturi section 46, serves to discharge fuel, as is metered by the main metering system, into the induction passage means 34.

A variably openable throttle valve 52, carried as by a rotatable throttle shaft 54, serves to variably control the discharge and flow of combustible (fuel-air) mixture into the inlet 44 of intake manifold 26. Suitable throttle control linkage means, as generally depicted at 57, is provided and operatively connected to throttle shaft 54 in order to affect throttle positioning in accordance or in response to vehicle operator demand. The throttle valve, as will become more evident, also serves to vary the rate of fuel flow metered by the associated idle fuel metering system and discharged into the induction passage means.

Carburetor body means 32 may be formed as to also define a fuel reservoir chamber 58 adapted to contain fuel 60 therein the level of which may be determined as by, for example, a float operated fuel inlet valve assembly as is generally well known in the art.

The main fuel metering system comprises passage or conduit means 62 communicating generally between fuel chamber 58 and a generally upwardly extending main fuel well 64 which, as shown, may contain a main well tube 66 which, in turn, is provided with a plurality of generally radially directed apertures 68 formed through the wall thereof as to thereby provide for communication as between the interior of tube 66 and the portion of the well 64 generally radially surrounding the tube 66. Conduit means 70 serves to commmunicate between the upper part of well 64 and the interior of discharge nozzle 50. Air bleed type passage means 72, comprising conduit means 74 and calibrated restriction or metering means 76, communicate as between a source of filtered air and the upper part of the interior of well tube 66. A main calibrated fuel metering restriction 78 is situated generally upstream of well 64, as for example in conduit means 62, in order to meter the rate of fuel flow from chamber 58 to main well 64. As is generally well known in the art, the interior of fuel reservoir chamber 58 is preferably pressure vented to a source of generally ambient air as by means of, for example, vent-like passage means 80 leading from chamber 58 to the inlet end 36 of induction passage 34.

Generally, as the engine is running, the inlet stroke of each power piston causes air flow through the induction passage 34 and venturi throat 48. The air thusly flowing through the venturi throat creates a low pressure commonly referred to as a vacuum. The magnitude of such a venturi vacuum, $P_v$, is determined primarily by the velocity of the air flowing through the venturi and, of course, such velocity is determined by the speed and power output of the engine. The difference between the pressure in the venturi and the air pressure within fuel reservoir chamber 58 causes fuel to flow from fuel chamber 58 through the main metering system. That is, the fuel flows through metering restriction 78, conduit means 62, up through well 64 and, after mixing with the air supplied by the main well air bleed means 72, passes through conduit means 70 and discharges from nozzle 50 into induction passage means 34. Generally, the calibrations of the various controlling elements are such as to cause such main metered fuel flow to start to occur at, for example, a vehicular speed of 30 m.p.h. at normal road load.

Engine and vehicle operation at conditions less than that initiating operation of the main metering system are achieved by operation of the idle fuel metering system which not only supplies metered fuel flow during curb idle engine operation but also at all other conditions of engine idle operation.

At curb idle and other relatively low speeds of engine operation, the engine does not cause a sufficient air flow through the venturi section 48 as to result in a venturi vacuum strong enough to operate the main metering system. Because of the relatively almost closed throttle valve means 52, which greatly restricts air flow into the intake manifold 26 at idle and low engine speeds, engine or intake manifold vacuum is of a relatively high magnitude. This high manifold vacuum serves to provide a pressure differential which operates the idel fuel metering system.

Generally, the idle fuel system is illustrated as comprising calibrated idle fuel restriction or metering means 82 communicating as between the fuel 60, within fuel reservoir or chamber 58, and a generally upwardly extending passage or conduit 84 which, at its upper end, is in communication with a second generally vertically extending conduit 86 the lower end of which communicates with a generally laterally extending conduit 88. A downwardly depending conduit 90 communicates at its upper end with conduit 88 while, at its lower end, it communicates with induction passage means 34 as through aperture means 92. The effective size of discharge aperture 92 is variably established as by an axially adjustable needle valve member 94 threadably carried by body 32. As generally shown and as generally known in the art, passage 88 may terminate in a relatively elongated discharge opening or aperture 96 located as to be generally juxtaposed to an edge of throttle valve 52 when such throttle valve 52 is in its curb-idle or nominally closed position. Often, aperture 96 is referred to in the art as being a transfer slot effectively increasing the area for flow of fuel to the underside of throttle valve 52 as the throttle valve is moved toward a more fully opened position.

Conduit means 98, provided with calibrated air metering or restriction means 100, serves to communicate as between an upper portion of conduit 86 and a source of atmospheric air as at the inlet end 36 of induction passage 34.

At idle engine operation, the greatly reduced pressure generally below the throttle valve means causes fuel to flow from the fuel reservoir 58 through restriction means 82 and upwardly through conduit means 84 where, generally at the upper portion thereof, the fuel intermixes with bleed air provided by conduit 98 and air bleed restriction means 100. The fuel-air emulsion then is drawn downwardly through conduit 86 and through conduits 88 and 90 ultimately being discharged, posterior to throttle valve 52, through the effective opening of aperture 92.

During off-idle operation, the throttle valve means 52 is moved in the opening direction causing the juxtaposed edge of the throttle valve to further effectively open and expose a greater portion of the transfer slot or port means 96 to the manifold vacuum existing posterior to the throttle valve. This, of course, causes additional metered idle fuel flow through the transfer port means 96. As the throttle valve means 52 is opened still wider and the engine speed increases, the velocity of air flow through the induction passage 34 increases to the point where the resulting developed venturi vacuum is sufficient to cause the hereinbefore described main metering system to be brought into operation.

The invention as herein disclosed and described provides means, in addition to those hereinbefore described, for controlling and/or modifying the metering characteristics otherwise established by the fluid circuit constants previously described. In the embodiment disclosed, among other cooperating elements, valving assemblies 102 and 104 are provided to enable the performance of such modifying and/or control functions.

Valving assembly 102 is illustrated as comprising variable but distinct chambers 106 and 108 effectively separated as by a pressure responsive wall or diaphragm member 110 which, in turn, has a valving member 112 operatively secured thereto for movement therewith. The valving surface 114 of valving member 112 cooperates with a calibrated aperture 116 of a member 118 as to thereby variably determine the effective cross-sectional flow area of said aperture 116 and, therefore, the degree to which communication between the upper portion of conduit 86 and chamber 108. Resilient means, as in the form of a compression spring 120 situated generally in chamber 108, serves to continually bias and urge wall or diaphragm member 110 and valving member 112 away from coacting aperture 116 and toward a fully opened position with respect thereto. As shown, chamber 108 is placed in communication with ambient atmosphere preferably through associated calibrated restriction or passage means 122 and via conduit means 98. Without at this time considering the overall operation, it should be apparent that for any selected differential between the manifold vacuum, $P_m$, and the pressure, $P_a$, within reservoir 58, the "richness" of the fuel delivered by the idle fuel metering system can be modulated merely by the moving of valving member 112 toward and/or away from coacting aperture means 116. That is, for such given pressure differential, the greater the effective opening of aperture means 116 becomes the more air is bled into the idle fuel passing from conduit 84 into conduit 86. Therefore, because of such generally proportionately greater rate of flow of idle bleed air, the less, proportionately, is the rate of metered idle fuel flow thereby causing a reduction in the richness (in terms of fuel) in the fuel-air mixture supplied through the induction passage 34 and into the intake manifold 26. The converse is also true; that is, as aperture means 116 is more nearly totally closed, the total rate of flow of idle bleed air becomes increasingly more dependent upon the comparatively reduced effective flow area of restriction means 100 thereby proportionately reducing the rate of idle bleed air and increasing, proportionately, the rate of metered idle fuel flow. Accordingly, there is an accompanying increase in the richness (in terms of fuel) in the fuel-air mixture supplied through the induction passage 34 and into the intake manifold 26.

Valving assembly 104 is illustrated as comprising upper and lower variable and distinct chambers 124 and 126 separated as by a pressure responsive wall or diaphragm member 128 to which is secured one end of a valve stem 130 as to thereby move in response to and in accordance with the movement of wall or diaphragm means 128. The structure 129 defining the lower portion of chamber 126 serves to provide guide surface means for guiding the vertical movement of valve stem 130 and the chamber 126, formed therein, is vented to atmospheric pressure, $P_a$, as by vent or aperture means 132.

A first compression spring 134 situated generally within chamber 126 continually urges valve stem 130 in an upward direction.

A valve member 140 having a valve surface 142, formed thereon, adapted to cooperate with a valving orifice 144 communicating generally between chamber 58 and a chamber-like area 146 which, in turn, communicates as via calibrated metering or restriction means 148 and conduit means 150 with a portion of the main metering system downstream of the main metering restriction means 78. As illustrated, such communication may be at a suitable point within the main well 64. Additional spring means 147, which may be situated generally in the chamber-like area 146, serves to continually urge valve member 142 and stem 130 upwardly.

Without at this time considering the overall operation of the invention, it should be apparent that for any selected metering pressure differential between the venturi vacuum, $P_v$, and the atmospheric pressure, $P_a$, within reservoir 58, the "richness" of the fuel mixture delivered by the main metering system can be modulated merely by the moving of valving member 140 toward and/or away from coacting aperture means 144. That is, for any such given metering pressure differential the greater the effective opening of aperture means 144 becomes the greater also becomes the rate of metered fuel flow since one of the factors controlling such rate is the effective area of the metering orifice means. With the opening of orifice means 144 it can be seen that the then effective metering area of orifice 144 is, generally, additive to the effective metering area of orifice means 78. Therefore, a comparatively increased rate of metered fuel flow is discharged through nozzle 50, into the induction passage 34.

As shown, chambers 106 and 124 are each in communication with conduit means 152 as via conduit means 154 and 156, respectively.

As illustrated in FIGS. 1 and 2, conduit means 152 is placed in communication with associated conduit means 158 effective for conveying a superatmospheric fluid control pressure, $P_c$, to said conduit 152 and chambers 106 and 124. As shown in FIG. 1, suitable air pump means 149, driven as through power transmitting belt means 151 operatively connected to the engine 10, provides a supply of superatmospheric air pressure air conduit means 153 to regulating valve means 172.

FIG. 1 also illustrates suitable logic control means 160 which, as contemplated in the preferred mode of operation of the invention, may be electrical logic control means having suitable electrical signal conveying conductor means 162, 164, 166 and 168 leading thereto for applying electrical input signals, reflective of selected operating parameters, to the circuitry of logic means 160. It should of course, be apparent that such input signals may convey the required information in terms of the magnitude of the signal as well as conveying information by the absence of the signal itself. Output electrical conductor means as at 170 serves to convey the output electrical control signal from the logic means 160 to associated electrically operated control valve means 172. A suitable source of electrical potential 174 is shown as being electrically connected to logic means 160 while control valve 172 may be electricaly grounded as at 176.

In the preferred embodiment, the various electrical conductor means 162, 164, 166 and 168 are respectively connected to parameter sensing and transducer signal producing means 178, 180 and 182. The means 178 comprises oxygen sensor means communicating with exhaust conduit means 22 at a point generally upstream of a catalytic converter 184. The transducer means 180 may comprise electrical switch means situated as to be actuated by cooperating lever means 186 fixedly carried as by the throttle shaft 54 and swingably rotatable therewith into and out of operating engagement with switch means 180 in order to thereby provide a signal indicative of the throttle 52 having attained a preselected position. The transducer 182 may comprise temperature responsive means, such as, for example, thermocouple means, effective for sensing engine temperature and creating an electrical signal in accordance therewith.

Even though the invention is not so limited, it is, nevertheless, contemplated that the catalytic converter means 184 would preferably be of the "three-way" type of catalytic converter as hereinbefore described and as is generally well known in the art. Further, any of many presently available and suitable oxygen sensor assemblies may be employed. Also, although the invention is not so limited, control valve means 172 may comprise a three-way solenoid valving assembly effective for opening and closing (or otherwise modulating) aperture means for causing a varying effective restrictive effect upon fluid flow through such aperture means and thereby vary the effective pressure magnitudes on opposite sides of such aperture means. By varying the electrical signal to such a three-way solenoid valving assembly, it then becomes possible to selectively vary and establish the magnitude of at least one of the fluid pressures (at opposite sides of the modulated aperture means) and employ such as a control pressure (in this case, $P_c$). Various forms of such and other control valve assemblies are well known in the art and since the practice of the invention is not limited to any specific construction, any suitable control valve assembly may be employed.

OPERATION OF THE INVENTION

Generally, the oxygen sensor 178 senses the oxygen content of the exhaust gases and, in response thereto, produces an output voltage signal which is proportional or otherwise related thereto. The voltage signal is then applied, as via conductor means 162, to the electronic logic and control means 160 which, in turn, compares the sensor voltage to a bias or reference voltage which is indicative of the desired oxygen concentration. The resulting difference between the sensor voltage signal and the bias voltage is indicative of the actual error and an electrical error signal, reflective of the actual error, is employed to produce a related operating voltage which is applied to the control valve assembly 172 as by means of conductor 170.

Superatmospheric air pressure supplied by pump means 149 is conveyed via conduit means 153 to a conduit portion 194 of control valve assembly 172. The operation of control valve assembly 172 is such as to, for example, effectively variably bleed or vent a portion of the superatmospheric air pressure and thereby determine a resulting magnitude a superatmospheric control pressure, $P_c$, which is applied to conduit means 158. The magnitude of such control pressure, $P_c$, is, as previously generally described, determined by the electrical control signal and consequent operating voltage applied via conductor means 170 to control valve assembly 172.

As best seen in FIG. 2, the superatmospheric control pressure, $P_c$, is applied via conduit means 152 to both pressure responsive motor means 102 and 104, and more specifically to respective chambers 106 and 124 thereof. Generally, as should be apparent, the lesser the magnitude of $P_c$ the more upwardly are wall or diaphragm members 110 and 128 urged. The degree to which such members 110 and 128 are actually moved upwardly depends, of course, on the resilient force exhibited by spring means 120, 134 and 147.

Figure 3:
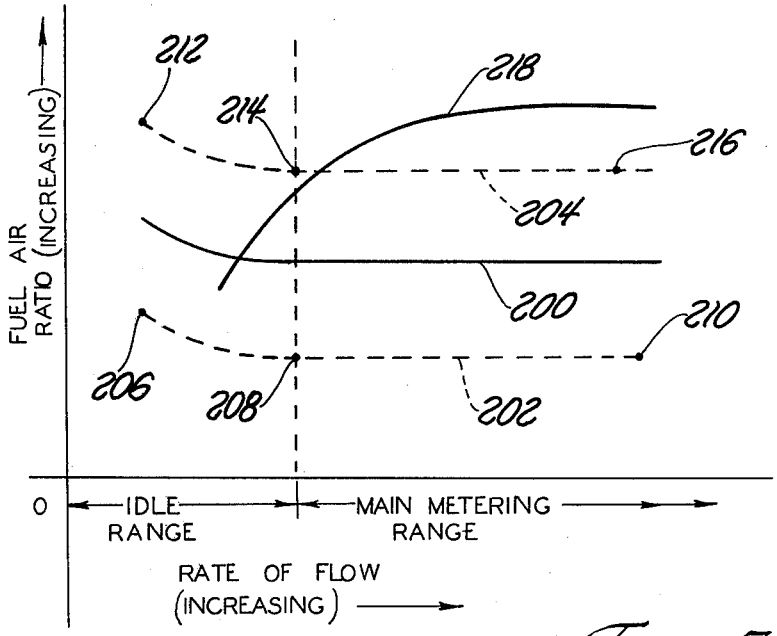
FIG. 3 is a graph illustrating, generally, fuel-air ratio curves obtainable with structures employing the invention.

The graph of FIG. 3 generally depicts fuel air ratio curves obtainable by the invention. For purposes of illustration, let it be assumed that curve 200 represents a combustible mixture, metered as to have a ratio of 0.068 lbs. of fuel per pound of air. Then, as generally shown, the carbureting device of the invention could provide a flow of combustible mixtures in the range anywhere from a selected lower-most fuel-air ratio as depicted by curve 202 to an uppermost fuel-air ratio as depicted by curve 204. As should be apparent, the invention provides an infinite family of such fuel-air ratio curves between and including curves 202 and 204. This becomes especially evident when one considers that the portion of curve 202 generally between points 206 and 208 is achieved when valve member 112 of FIG. 2 is moved upwardly as to thereby open orifice 116 to its maximum intended effective opening and cause the introduction of a maximum amount of bleed air therethrough. Similarly, that portion of curve 202 generally between points 208 and 210 is achieved when valve member 142 is moved upwardly as to thereby close orifice 144 to its intended minimum effective opening (or totally effectively closed) and cause the flow of fuel therethrough to be terminated or reduced accordingly.

In comparison, that portion of curve 204 generally between points 212 and 214 is achieved when valve member 112 is moved downwardly as to thereby close orifice 116 to its intended minimum effective opening (or totally effectively closed) and cause the flow of bleed air therethrough to be terminated or reduced accordingly. Similarly, that portion of curve 204 generally between points 214 and 216 is achieved when valve member 142 is moved downwardly as to thereby open orifice 144 to its maximum intended opening and cause a corresponding maximum flow of fuel therethrough.

It should be apparent that the degree to which orifices 116 and 144 are respectively opened, during actual operation, depends on the magnitude of the control pressure, $P_c$, which, in turn, depends on the control signal produced by the logic control means 160 and, of course, the control signal thusly produced by means 160 depends, basically on the input signal obtained from the oxygen sensor 178 as compared to the previously referred-to bias or reference signal. Accordingly, knowing what the desired composition of the exhaust gas from the engine should be (this possibly being based merely on the capacity of the catalytic converter 184) it then becomes possible to program the logic of means 160 as to create signals indicating deviations from such desired composition as to in accordance therewith modify the effective opening of orifices 116 and 144 to increase and/or decrease the richness (in terms of fuel) of the fuel-air mixture being metered to the engine. Such changes or modifications in fuel richness, of course, are, in turn, sensed by the oxygen sensor 160 which continues to further modify the fuel-air ratio of such metered mixture until the desired ratio is attained. Accordingly, it is apparent that the system disclosed defines a closed-loop feedback system which continually operates to modify the fuel-air ratio of a metered combustible mixture assuring such mixture to be of a desired fuel-air ratio for the then existing operating parameters.

It is also contemplated that at least in certain circumstances the uppermost curve 204 may actually be, for the most part, effectively below a curve 218 which, in this instance, is employed to represent a hypothetical curve depicting the best fuel-air ratio of a combustible mixture for obtaining maximum power from engine 10 as during wide open throttle (WOT) operation. In such a contemplated contingency, the invention provides transducer means 180 (FIG. 1) adapted to be operatively engaged as by lever means 186 when throttle valve 52 has been moved to WOT condition. At that time, the resulting signal from transducer means 180, as applied to means 160, causes logic means 160 to approximately respond by further altering the effective opening of orifices 116 and 144. That is, if it is assumed that curve portion 214-126 is obtained when effective opening of orifices 116 and 144. That is, if it is assumed that curve portion 214-126 is obtained when effectively opened to a degree less than its actual maximum physical opening, then further effective opening thereof may be accomplished by causing a further downward movement of valve member 140. During such phase of operation, the metering becomes an open loop function and the input signal to logic means 160 provided by oxygen sensor 178 is, in effect, for so long as the WOT signal from transducer 180 exists.

Similarly, in certain engines, because of any number of factors, it may be desirable to assure a lean (in terms of fuel richness) fuel-air ratio immediately upon starting of a cold engine. Accordingly, the invention contemplates the use of engine temperature transducer means 182 which is effective for producing a signal, over a predetermined range of low engine temperatures, and applying such signal to logic control means 160 as to thereby cause such logic means 160 to, in turn, produce and apply a control signal, via 170 to control valve 172, the magnitude of which is such as to cause the resulting fuel-air ratio of the metered combustible mixture to be, for example, in accordance with curve 202 of FIG. 3 or some other selected relatively "lean" fuel-air ratio.

Further, it is contemplated that at certain operating conditions and with certain oxygen sensors, it may be desirable or even necessary to measure the temperature of the oxygen sensor itself. Accordingly, suitable temperature transducer means, as for example thermocouple means well known in the art, may be employed to sense the temperature of the operating portion of the oxygen sensor means 178 and to provide a signal in accordance or in response thereto via conductor means 164 to the electronic control means 160. That is, it is anticipated that it may be necessary to measure the temperature of the sensory portion of the oxygen sensor 178 to determine that such sensor 178 is sufficiently hot to provide a meaningful signal with respect to the composition of the exhaust gas. For example, upon re-starting a generally hot engine, the engine temperature and engine coolant temperatures could be normal (as sensed by transducer means 182) and yet the oxygen sensor 178 is still too cold and therefore not capable of providing a meaningful signal, of the exhaust gas composition, for several seconds after such engine re-start. Accordingly, it is advantageous, during the time that sensor means 178 is thusly too cold, to provide a relatively "lean" fuel-air mixture. The sensor means 178 temperature signal thusly provided along conductor means 164 serves to cause such logic means 160 to, in turn, produce and apply a control signal, via 170 to control valve means 172, the magnitude of which is such as to cause the resulting fuel-air ratio of the metered combustible mixture to be, for example, in accordance with curve 202 of FIG. 3 or some other selected relatively "lean" fuel-air ratio.

Figure 4:
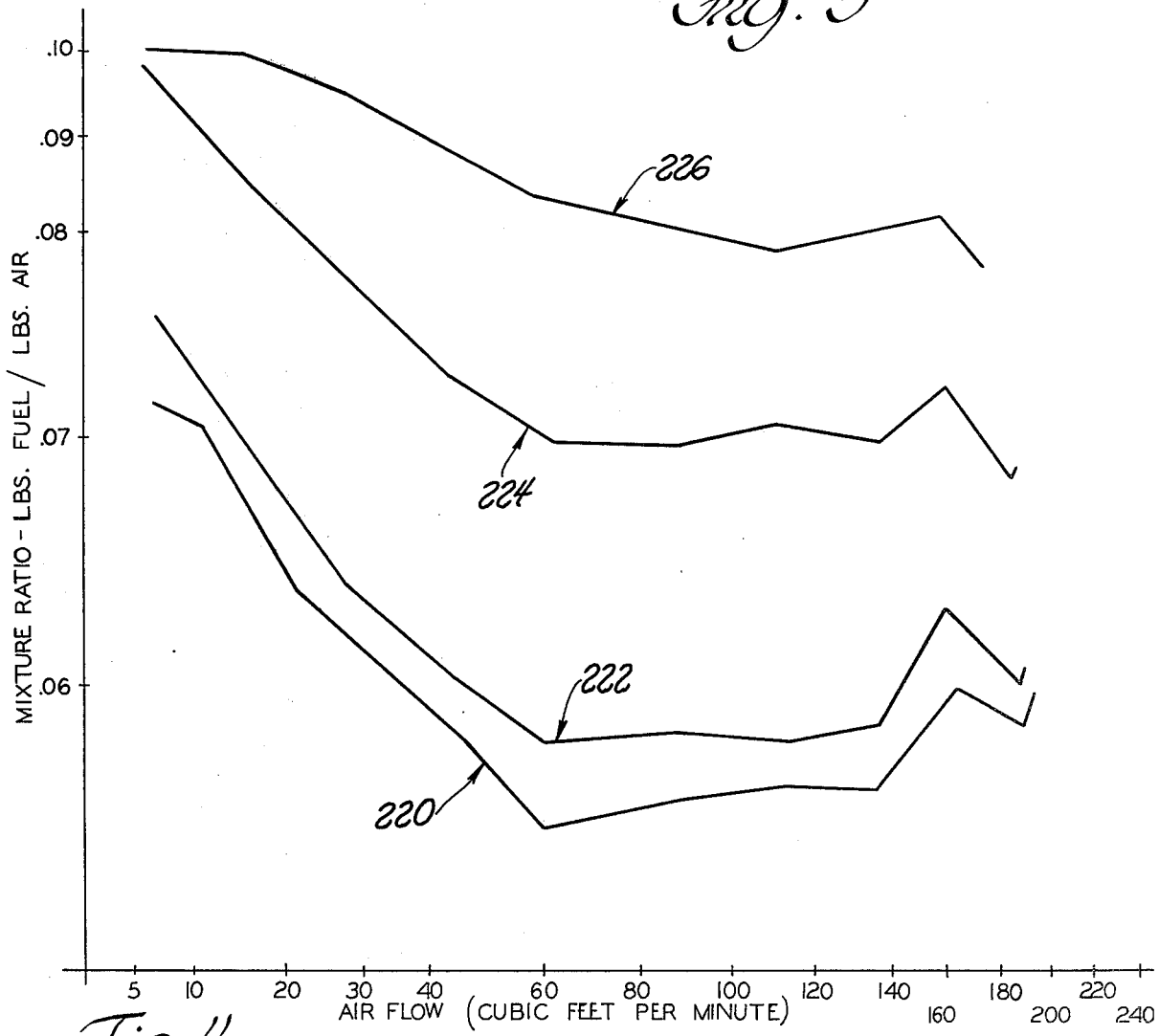
FIG. 4 is a graph depicting fuel-air ratio curves obtainable from a carburetor embodying at least certain of the teachings of the invention.

FIG. 4 illustrates fuel-air mixture curves obtained during testing of one particular carburetor employing modulating valving members as generally depicted by 112 and 140 of FIG. 2, with such curves being obtained at varying magnitudes of control pressure, $P_c$. As can be seen, comparatively, the magnitude of the control pressure, $P_c$, is lowest for flow curve 220 and is progressively greater for flow curve 222 and still progressively greater for flow curve 224 while the comparatively greatest magnitude of control pressure, $P_c$, is for flow curve 226. It should be noted that flow curve 220 corresponds generally to a typical part throttle fuel delivery curve while the flow curve 226 corresponds generally to a typical best engine power or wide open throttle delivery curve. Accordingly, it can be seen that in the event of a total electronic or even air pump 149 failure, the associated vehicle remains drivable regardless of whether such failure results in either maximum or minimum applied pressure (to motor means 102 and 104) or any value therebetween.

Figure 5:
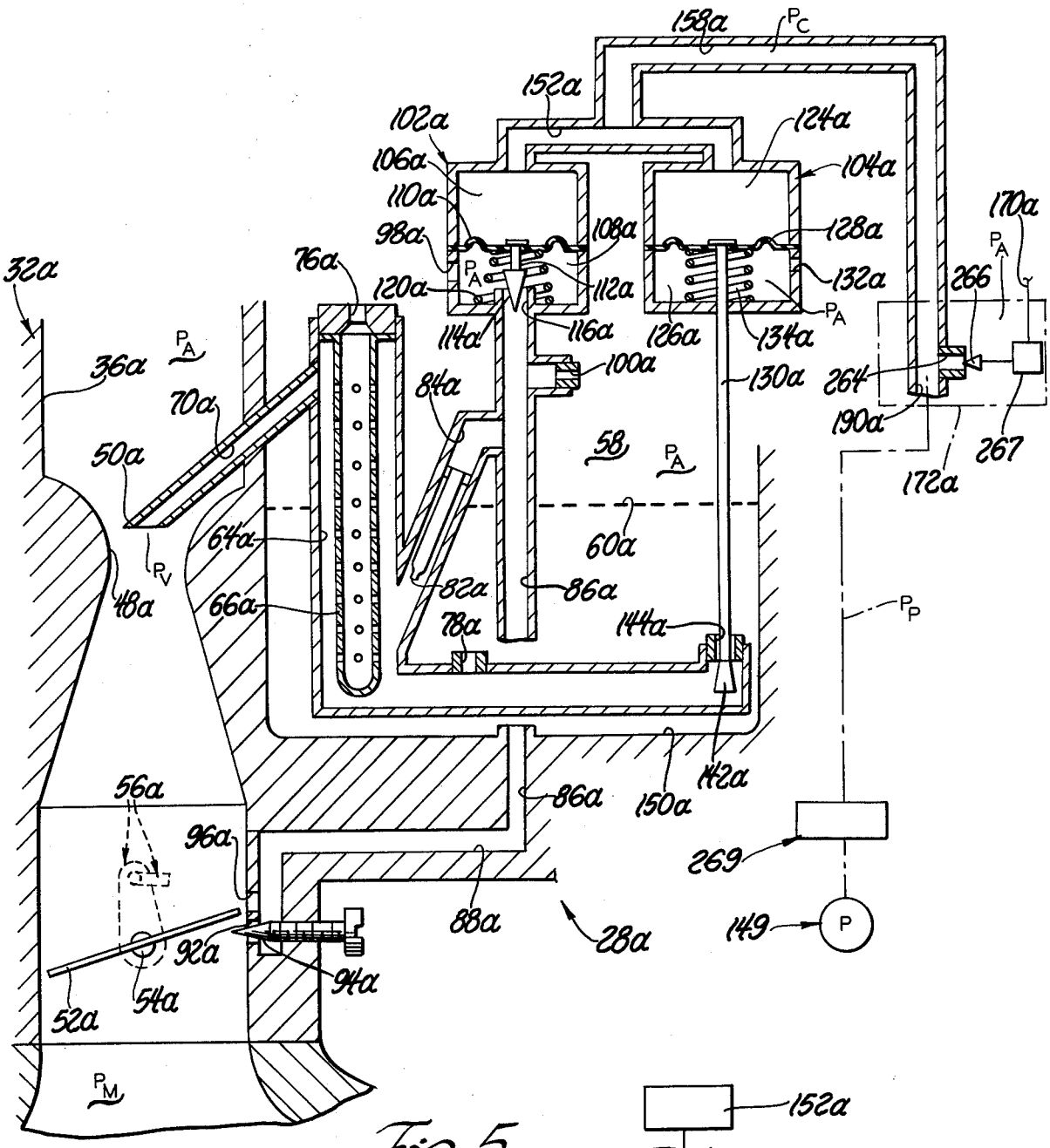
FIG. 5 is a generally cross-sectional view of another form of the invention.

FIG. 5, in somewhat simplified and diagrammatic form, illustrates a further form of the invention. All elements in FIG. 5 which are like or similar to those of FIGS. 1 and 2 are identified with like reference numbers provided with a suffix "*a*".

In the embodiment of FIG. 5 conduit or passage means **158*a* is illustrated as communicarting with air pump means 149 thru orifice means 262 and is further provided with vent means comprised of a valve-like orifice means 264 adapted to cooperate with, for example, a solenoid operated valve member 266 the operation of which, in turn, is controlled by related control means 267 operatively connected, via 170*a*, to logic or electronic control means 160 (FIG. 1). Means 267 serves to variably but controllably determine the effective flow area of valve orifice 264 in order to thereby vary the effective magnitude of the resulting superatmospheric control pressure, $P_c$, within passage 158*a* and chambers 106*a* and 124*a*. If desired, suitable pressure regulating means, as generally schematically depicted at 269, may be employed to thereby establish a source of generally stable superatmospheric pressure regardless of possible variations in the pumping action of air pump means 149. Such pressure regulator and/or accumulator means 269 are well known in the art and since the specific construction thereof forms no part of the invention, any such means 269**, if such be desired, may be employed.

Figure 6:
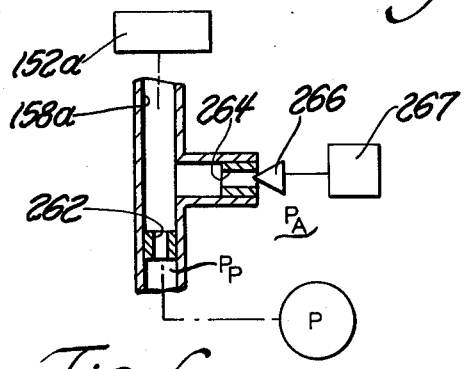
FIGS. 6 and 7 are each generally fragmentary and schematic illustration of different arrangements for variably and controllably determinging the magnitude of the actuating pressure differential employed in the invention.
Figure 7:
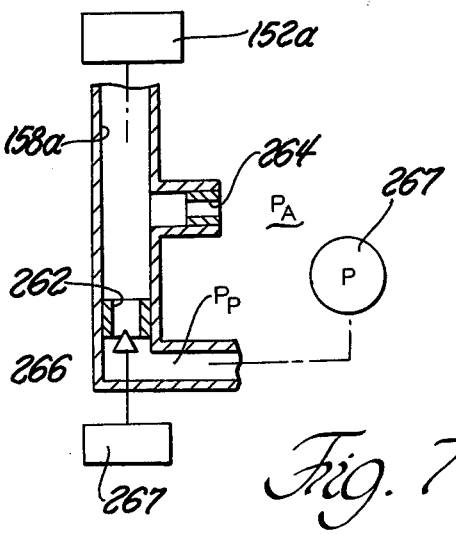

Various control valving means are contemplated. FIGS. 6 and 7 schematically illustrate two general arrangements of which FIG. 6 corresponds generally to the system of FIG. 6 wherein a valving member variably controls the degree of pressure venting through controlled aperture means 264. FIG. 7 illustrates another general arrangement wherein the valving member 266 serves to variably control the degree of communication of the pump pressure, $P_p$, (regulated or unregulated) with passage means **158*a*. Obviously, combinations of such systems are generally depicted by FIGS. 6 and 7** could also be employed.

It should be pointed out that air pump means 149 may actually be the same air pump apparatus currently employed by the prior art for supplying atmospheric air, as via conduit means fragmentarily shown at 271, to the exhaust gases within the exhaust system. The invention may, of course, be practiced with or without such additional air being pumped into the exhaust gases.

Although only one preferred embodiment and selected modifications of the invention have been disclosed and described, it is apparent that other embodiments and modifications of the invention are possible within the scope of the appended claims.

I claim:

1. A carburetor for a combustion engine, comprising induction passage means for supplying motive fluid to said engine, a source of fuel, main fuel metering system means communicating generally between said source of fuel and said induction passage means, idle fuel metering system means communicating generally between said source of fuel and said induction passage means, selectively controlled pressure responsive modulating valving means effective to controllably increase or decrease the rate of metered fuel flow through each of said main fuel metering system means and said idle fuel metering system means, said modulating valve means being constructed so as to be effective to so alter said rate of metered fuel flow in response to a single control signal means generated as a consequence of selected indicia of engine operation, and pressure passage means effective for communicating with a source of superatmospheric fluid pressure for supplying a superatmospheric working pressure to said modulating valving means.

2. A carburetor according to claim 1 wherein said modulating valving means comprises pressure responsive motor means.

3. A carburetor according to claim 1 wherein said modulating valving means comprises first and second valve means, wherein said idle fuel metering system means comprises idle air bleed means, wherein said first valve means is effective to vary the effective flow area of said idle air bleed means in order to thereby increase and decrease said rate of metered fuel flow through said idle fuel metering system means, wherein said main fuel metering means comprises metering restriction means, and wherein said second valve means is effective to vary the effective flow area of said metering restriction means to thereby increase and decrease said rate of metered fuel flow through said main fuel metering system means.

4. A carburetor according to claim 3 wherein said main fuel metering system means comprises first and second passage means communicating with said source of fuel, wherein said metering restriction means comprises first and second flow restrictor means, wherein said first and second flow restrictor means are respectively situated in said first and second passage means, wherein said second valve means is effective to vary the effective flow area of said second flow restrictor means, and wherein said second passage means communicates generally with said first passage means at a point downstream of said first restrictor means.

5. A carburetor according to claim 3 wherein said idle air bleed means comprises first and second air bleed orifices, and wherein said first valve means is effective for varying the effective flow area of said first air bleed orifice.

6. A carburetor according to claim 3 wherein said idle air bleed means comprises first and second air bleed orifices, wherein said first valve means is effective for varying the effective flow area of said first air bleed orifice, wherein said main fuel metering system means comprises first and second passage means communicating with said source of fuel, wherein said metering restriction means comprises first and second flow restrictor means, wherein said first and second flow restrictor means are respctively situated in said first and second passage means, wherein said second valve means is effective to vary the effective flow area of said second flow restrictor means, and wherein said second passage means communicates generally with said first passage means at a point downstream of said first restrictor means.

7. A carburetor according to claim 1 and further comprising venturi means carried in said induction passage means, wherein said main fuel metering system means comprises main fuel discharge nozzle means situated generally in the throat of said venturi means, and further comprising variably positionable throttle valve means situated in said induction passage means, idle fuel discharge aperture means formed in a wall of said induction passage means and situated as to be generally juxtaposed to a portion of said throttle valve means.

8. A carburetor according to claim 7 wherein said main fuel metering system means further comprises a main fuel well, a first flow restrictor communicating between said source of fuel and said main fuel well, a second flow restrictor communicating between said main fuel well and said source of fuel, said first and second flow restrictors being in generally parallel flow relationship to each other, and wherein said modulating valving means is effective for varying the effective flow area of one of said first and second flow restrictors.

9. A carburetor according to claim 8 wherein said idle fuel metering system means comprises first air bleed orifice means effective for bleeding generally ambient atmospheric air into the fuel flowing through said idle fuel metering system means, and further comprising second air bleed orifice means effective for bleeding generally ambient atmospheric air into said fuel flowing through said idle fuel metering system means, and wherein said modulating valving means is effective for varying the effective flow area of said second air bleed orifice means.

10. A carburetor according to claim 9 wherein said modulating valving means comprises a first variably positionable valve member, a second variably positionable valve member, a first pressure responsive wall member operatively connected to said first valve member, a second pressure responsive wall member operatively connected to said second valve member, said first and second wall members each being adapted to be exposed to a controlled pressure differential created by said working pressure and atmospheric pressure as to be thereby urged in respective first directions, and resilient means operatively connected to said first and second valve members to yieldingly resist movement of said first and second members in said first directions.

11. A fuel metering system for a combustion engine having engine exhaust conduit means, comprising fuel carbureting means for supplying metered fuel flow to said engine, said carbureting means comprising induction passage means for supplying motive fluid to said engine, a source of fuel, main fuel metering system means communicating generally between said source of fuel and said induction passage means, idle fuel metering system means communicating generally between said source of fuel and said induction passage means, controlled modulating valving means effective to controllably increase and decrease the rate of metered fuel flow through each of said main fuel metering system means and said idle fuel metering system means, air pump means effective for producing a superatmospheric pressure to be applied to said modulating valving means for operation thereof, oxygen sensor means effective for sensing the relative amount of oxygen present in engine exhaust gases flowing through said exhaust conduit means and producing in accordance therewith a first output signal, and logic control means effective for receiving said first output signal and in response thereto producing a second single output signal, and means responsive to said second output effective to cause said modulating means to increase and decrease said rate of metered fuel flow.

12. A fuel metering system according to claim 11 and further comprising a transducer means for sensing engine temperature and producing in response thereto a second output signal, and wherein said logic control means is effective for receiving said second output signal as an input thereto.

13. A fuel metering system according to claim 11 and further comprising transducer means for sensing when said engine is operating at idle condition and producing in response thereto a second output signal, and wherein said logic control means is effective for receiving said second output signal as an input thereto.

14. A fuel metering system according to claim 11 and further comprising variably positionable throttle valve means in said induction passage means, transducer means for sensing when said throttle valve means is at or near a wide open condition and producing in response thereto a second output signal, and wherein said logic control means is effective for receiving said second output signal as an input thereto.

15. A fuel metering system according to claim 11 and further comprising first transducer means for sensing engine temperature and producing a second output signal in response thereto, throttle valve means situated in said induction passage means, and second transducer means for sensing when said throttle valve means is in a wide open condition and producing a third output signal in response thereto, and wherein said logic control means is effective for receiving said second and third output signals as inputs thereto.

16. A fuel metering system according to claim 11 and further comprising pressure transmitting conduit means effective for transmitting said superatmospheric pressure from said air pump means to said modulating valving means, and wherein said logic control means comprises pressure control valve means for regulating the magnitude of said superatmospheric pressure applied to said modulating valving means.

17. An internal combustion engine, comprising a plurality of engine cylinders, a valve-controlled induction system for supplying motive fluid to said cylinders, separate main and idle fuel supply means discharging fuel into said induction system, an exhaust system for carrying engine exhaust gases from said cylinders, at least two means for sensing different engine operating parameters, and providing an output signal in accordance with each of said sensed parameters, parameter signal processing means for receiving said parameter output signals as inputs thereto and providing a resultant output signal reflective of said input signals, a fluid control superatmospheric pressure system operative to influence the operation of both of said separate main and idle fuel supply means, said pressure system communicating with a source of superatmospheric pressure generated by operation of said engine and including single means responsive to said resultant output for modifying said control pressure therein, and thus said main and idle fuel, in accordance with said engine operating parameters.

18. An engine such as that recited in claim 17, wherein one of said parameters is oxygen content of said exhaust.

19. An engine such as that recited in claim 17, wherein one of said parameters is induction system control valve position.

20. An engine such as that recited in claim 17, wherein one of said parameters is engine temperature.

21. An engine such as that recited in claim 17, wherein said output signals from said processing means are electrical signals, said fluid control pressure is superatmospheric pressure generated by an engine driven air pump and said means for modifying control pressure comprises a solenoid-operated valve.

22. An engine such as that recited in claim 17, wherein said output signals from said processing means are electrical signals, said fluid control pressure is a superatmospheric pressure and said means for modifying control pressure comprises a solenoid-operated valve effective to modify said control pressure.

23. An engine such as that recited in claim 17, wherein said source of superatmospheric is the engine emission control air pump.

24. An engine such as that recited in claim 17, wherein the signal from one of said parameters is processed for closed-loop control and the signal from another of said parameters is processed for open-loop control.

* * * * *